US006947886B2

(12) United States Patent
Rose et al.

(10) Patent No.: US 6,947,886 B2
(45) Date of Patent: Sep. 20, 2005

(54) SCALABLE COMPRESSION OF AUDIO AND OTHER SIGNALS

(75) Inventors: Kenneth Rose, Ojai, CA (US); Ashish Aggarwal, Simi Valley, CA (US); Shankar L. Regunathan, Bellevue, WA (US)

(73) Assignee: The Regents of the University of California, Oakland, CA (US)

( * ) Notice: Subject to any disclaimer, the term of this patent is extended or adjusted under 35 U.S.C. 154(b) by 379 days.

(21) Appl. No.: 10/372,047

(22) Filed: Feb. 21, 2003

(65) Prior Publication Data

US 2003/0212551 A1 Nov. 13, 2003

Related U.S. Application Data

(60) Provisional application No. 60/359,165, filed on Feb. 21, 2002.

(51) Int. Cl.[7] ..... G10L 19/00
(52) U.S. Cl. ..... 704/200.1
(58) Field of Search ..... 704/200, 200.1, 704/230, 247, 500–501

(56) References Cited

U.S. PATENT DOCUMENTS

| | | | | |
|---|---|---|---|---|
| 5,612,900 A | * | 3/1997 | Azadegan et al. | 709/247 |
| 5,734,679 A | | 3/1998 | Nomura | |
| 5,774,844 A | | 6/1998 | Akagiri | |
| 6,009,387 A | | 12/1999 | Ramaswamy et al. | |
| 6,029,126 A | | 2/2000 | Malvar | |
| 6,098,039 A | | 8/2000 | Nishida | |
| 6,108,626 A | * | 8/2000 | Cellario et al. | 704/230 |
| 6,349,284 B1 | * | 2/2002 | Park et al. | 704/500 |
| 2003/0058931 A1 | | 3/2003 | Zhang et al. | |
| 2003/0212551 A1 | * | 11/2003 | Rose et al. | 704/230 |

OTHER PUBLICATIONS

"Towards Weighted Mean–Squared Error Optimality of Scalable Audio Coding", a dissertation submitted in partial satisfaction of requirements for the degree Doctor of Philosophy in Electrical and Computer Engineering by Ashish Aggarwal, dated Dec. 2002.

Article in Audio Engineering Society entitled "Compander Domain Approach to Scalable AAC", by Ashish Aggarwal, Shankar Regunathan and Kenneth Rose, University of California, presented at the 110$^{th}$ Convention May 12–15, 2001 Amsterdam.

Article "A Conditional Enhancement–Layer Quantizer For the Advanced Audio Coder", by Ashish Aggarwal and Kenneth Rose, ICASSP 2002.

Article entitled "Asympototically Optimal Scalable Coding for Minimum Weighted Mean Square Error", by Ashish Aggarwal, Shankar Regunathan and Kenneth Rose, Data Compression Conference, Nov. 15, 2000.

* cited by examiner

*Primary Examiner*—David D. Knepper
(74) *Attorney, Agent, or Firm*—Fulbright & Jaworski

(57) ABSTRACT

Disclosed are scalable quantizers for audio and other signals characterized by a non-uniform, perception-based distortion metric, that operate in a common companded domain which includes both the base-layer and one or more enhancement-layers. The common companded domain is designed to permit use of the same unweighted MSE metric for optimal quantization parameter selection in multiple layers, exploiting the statistical dependence of the enhancement-layer signal on the quantization parameters used in the preceding layer. One embodiment features an asymptotically optimal entropy coded uniform scalar quantizer. Another embodiment is an improved bit rate scalable multi-layer Advanced Audio Coder (AAC) which extends the scalability of the asymptotically optimal entropy coded uniform scalar quantizer to systems with non-uniform base-layer quantization, selecting the enhancement-layer quantization methodology to be used in a particular band based on the preceding layer quantization coefficients. In the important case that the source is well modeled as Laplacian, the optimal conditional quantizer is implementable by only two distinct switchable quantizers depending on whether or not the previous quantizer identified the band in question as a so-called "zero dead-zone:" Hence, major savings in bit rate are recouped at virtually no additional computational cost. For example, the proposed four layer scalable coder consisting of 16 kbps layers achieves performance close to a 60 kbps non-scalable coder on the standard test database of 44.1 kHz audio.

27 Claims, 7 Drawing Sheets

SCALABLE COMPRESSION OF AUDIO AND OTHER SIGNALS

CROSS REFERENCE TO RELATED APPLICATIONS

This application claims the benefit of provisional application No. 60/359,165 filed Feb. 21, 2002.

STATEMENT REGARDING FEDERALLY FUNDED RESEARCH OR DEVELOPMENT

This invention was made with Government support under Grant Nos. MIP-9707764, EIA-9986057 and EIA-0080134, awarded by the National Science Foundation. The Government has certain rights in this invention.

TECHNICAL FIELD

This disclosure relates generally to bit rate scalable coders, and more specifically to bit-rate scalable compression of audio or other time-varying spectral information.

TECHNICAL BACKGROUND

Bit rate scalability is emerging as a major requirement in compression systems aimed at wireless and networking applications. A scalable bit stream allows the decoder to produce a coarse reconstruction if only a portion of the entire coded bit stream is received, and to improve the quality when more of the total bit stream is made available. Scalability is especially important in applications such as digital broadcasting and multicast, which require simultaneous transmission over multiple channels of differing capacity. Further, a scalable bit stream provides robustness to packet loss for transmission over packet networks (e.g., over the Internet). A recent standard for scalable audio coding is MPEG-4 which performs multi-layer coding using Advanced Audio Coding (AAC) modules.

Advanced Audio Coding in the Base-layer

FIG. 1 shows a block diagram of a conventional base-layer AAC encoder module 10. The "transform and pre-processing" block 12 converts the time domain data 14 into the spectral domain 16. A switched modified discrete cosine transform is used to obtain a frame of 1024 spectral coefficients. The time domain data 14 is also used by the psychoacoustic model 18 to generate the masking threshold 20 for the spectral coefficients 14. The spectral coefficients are conventionally grouped into 49 bands to mimic the critical band model of the human auditory system. All transform coefficients within a given band are quantized (block 22) using the same generic non-uniform Scalar Quantizer (SQ). Equivalently, the transform coefficients are compressed by a corresponding non-linear reversible compression function c(x) 24 (which for AAC is $|x|^{0.75}$), and then quantized using a Uniform SQ (USQ) 26 after a dead-zone rounding of 0.0946 (see FIG. 2). We thus have $$ix=\text{sign}[x].nint\{\Delta c(x)-0.0946\},$$

$$\hat{x}=\text{sign}[ix].c^{-1}(|ix|+0.0946)/\Delta), \quad (1)$$

where, x and $\hat{x}$ are original and quantized coefficients, $\Delta$ is the quantizer scale factor of the band and, nint and sign represent nearest-integer and signum functions respectively.

Exemplary implementations of the scale factor 28 and quantization blocks 30 of FIG. 1 are shown in further detail in FIG. 2. The quantizer scale factor $\Delta_i$ 32 of each band is adjusted to match the masking profile, and thus, to minimize the average NMR of the frame for the given bit rate. The quantized coefficients 34 in each band are integers which are entropy coded using a Huffman codebook (not shown), and transmitted to the decoder. The quantizer scale factor $\Delta_i$ 32 for each band is transmitted as side information. The decoder 36 uses the same Huffman codebook to decode the encoded data, descaling it ($\Delta_i^{-1}$) and expanding it ($c^{-1}$)to reconstruct a replica $\hat{x}$ of the original data x.

In the case of audio signal, it is generally true that when the value of a particular coefficient is high, a higher amount of distortion can be allowed in its quantization while maintaining perceptual quality. Therefore, a non-uniform quantizer, which may be implemented as a compressor 24 and USQ 26 in the companded domain, is used in AAC to quantize the coefficients. Since the allowed distortion, or the masking threshold associated with each band is not necessarily constant, the quantizer scale factor will vary from band to band, and AAC transmits these stepsizes as side information. A widely used metric for measuring the distortion is the noise-to-mask ratio (NMR), which is a weighted MSE (WMSE) measure. Typically, the PsychoAcoustic Model will define the WSME metric to measure the perceived distortion, and the quantizer scale factors are selected to minimize that WSME distortion metric.

Re-quantization in the Enhancement-layer

FIG. 3 shows a conventional direct re-quantization approach for a bit rate scalable coder. Such an approach, for example, is applied in each band of a two-layer scalable AAC. Here, $\Delta_b$ 40 and $\Delta_e$ 42 represent the quantizer scale factors for the base and the enhancement-layer, respectively. The reconstruction error z is computed by subtracting (adder 44) the reconstructed base-layer data $\hat{x}_b$ from the original data x, and the enhancement-layer directly re-quantizes that reconstruction error z. The replica of x (i.e., $\hat{x}$) is generated by adding the reconstructed approximations from the base-layer and the enhancement-layer, i.e., $\hat{x}_b$ and $\hat{z}$ respectively. The quantized indices and the quantizer scale factor are transmitted separately for the base-layer as well as for the enhancement-layer. The scale factors are chosen so as to minimize the distortion in the frame, for the target bit rate at that layer.

In a typical conventional approach to scalable coding, each enhancement-layer merely performs a straightforward re-quantization of the reconstruction error of the preceding layer, typically using a straightforward re-scaled version of the previously used quantizer. Such a conventional approach yields good scalability when the distortion measure in the base-layer is an unweighted mean squared error (MSE) metric. However, a majority of practically employed objective metrics do not use MSE as the quality criterion and a simple direct re-quantization approach will not in general result in optimizing the distortion metric for the enhancement-layer. For example, in conventional scalable AAC, the enhancement-layer encoder searches for a new set of quantizer scale factors, and transmits their values as side information. However, the information representing the scale factors may be substantial. At low rates, of around 16 kbps, the information about quantizer scale factors of all the bands constitutes as much as 30%–40% of the bit stream in AAC.

SUMMARY OF THE INVENTION

In one embodiment, substantial improvement of reproduced signal quality at a given bit rate, or comparable reproduction quality at a considerably lower bit rate, may be accomplished by performing quantization for more than one layer in a common domain. In particular, the conventional scheme of direct re-quantization at the enhancement-layer using a quantizer that optimizes (minimizes) a given distortion metric such as the weighted mean-squared error (WMSE), which may be suitable at the base-layer, but is not so optimized for embedded error layers, may be replaced by a scalable MSE-based companded quantizer for both a base-layer and one or more error reconstruction layers. Such a scalable quantizer can effectively provide comparable distortion to the WMSE-based quantizer, but without the additional overhead of recalculated quantizer scale factors for each enhancement-layer and without the added distortion at a given bit rate when less than optimal quantizer intervals are used. This scalable quantizer approach has numerous practical applications, including but not limited to media streaming and real-time transmission over various networks, storage and retrieval in digital media databases, media on demand servers, and search, segmentation and general editing of digital data.

In particular, compared to an arbitrary multi-layer coding scheme with non-uniform entropy-coded scalar quantizers (ECSQ) that minimizes the weighted mean-squared error (WMSE), the described exemplary multi-layer coding system operating in the companded domain achieves the same operational rate-distortion bound that is associated with the resolution limit of the non-scalable entropy-coded SQ. Substantial gains may also be achieved on "real-world" sources, such as audio signals, where the described multi-layer approach may be applied to a scalable MPEG-4 Advanced Audio Coder. Simulation results of an exemplary two-layer scalable coder on the standard test database of 44.1 kHz sampled audio show that this companded quantizer approach yields substantial savings in bit rate for a given reproduction quality. In accordance with one aspect of the present invention, the enhancement-layer coder has access to the quantizer index and quantizer scale factors used in the base-layer and uses that information to adjust the stepsize at the enhancement-layer. Thus, much of the required side information representing enhancement-layer scale factors is, in essence, already included in the transmitted information concerning the baselayer.

In another embodiment, scalability may be enhanced in systems with a given base-layer quantization by the use of a conditional quantization scheme in the enhancement-layers, wherein the specific quantizer employed for quantization of a given coefficient at the enhancement-layer (given layer) is chosen depending on the information about the coefficient from the base-layer (preceding layer). In particular, an exemplary switched enhancement-layer quantization scheme can be efficiently implemented within the AAC framework to achieve major performance gains with only two distinct switchable quantizers: a uniform reconstruction quantizer and a "dead-zone" quantizer, with the selection of a quantizer for a particular coefficient of an error layer being a function of the quantized replica for the corresponding coefficient in the previously quantized layer. For example if the quantizer in the lower resolution layer identified the coefficient as being in the "dead-zone," i.e., one without substantial information content, then a rescaled version of that same dead-zone quantizer is used for the corresponding coefficient of the current enhancement-layer. Otherwise, a scaled version of a quantizer without "dead-zone," such as a uniform reconstruction quantizer, is used to encode the reconstruction error in those coefficients that have been found to have substantial information content. In one example, a scalable AAC coder consisting of four 16 kbps layers achieves a performance comparable in both bitrate and quality to that of a 60 kbps non-scalable coder on a standard test database of 44.1 kHz audio. For a Laplacian source such as audio, only two generic quantizers are needed at the error reconstruction layers to approach the distortion-rate bound of an optimal entropy-constrained scalar quantizer.

For additional background information, theoretical analysis, and related technology that may prove useful in making and using certain implementations of the present invention, reference is made to the recently published Doctoral Thesis of Ashish Aggarwal entitled "Towards Weighted Mean-Squared Error Optimality of Scalable Audio Coding", University of California, Santa Barbara, December 2002, which is hereby incorporated by reference in its entirety.

The invention is defined in the appended claims, some of which may be directed to some or all of the broader aspects of the invention set forth above, while other claims may be directed to specific novel and advantageous features and combinations of features that will be apparent from the Detailed Description that follows.

BRIEF DESCRIPTION OF THE DRAWINGS

It is to be expressly understood that the following figures are merely examples and are not intended as a definition of the limits of the present invention.

DETAILED DESCRIPTION OF REPRESENTATIVE EMBODIMENTS

Companded Scalable Quantization (CSQ) Scheme for Asymptotically WMSE-Optimal Scalable (AOS) Coding

ECSQ—Preliminaries

Let $x \in R$ be a scalar random variable with probability density function (pdf) $f_x(x)$. The WMSE distortion criterion is given by, $$D = \int_x (x - \hat{x}))^2 w(x) f_x(x) dx \tag{2}$$

where, $w(x)$ is the weight function and $\hat{x}$ is the quantized value of x.

Consider an equivalent companded domain quantizer, which consists of a compandor compression function $c(x)$ for performing a reversible non-linear mapping of the signal level followed by quantization in the companded domain using the equivalent uniform SQ with stepsize $\Delta$. For convenience, we will refer to the structure implementing the compression function $c(x)$ as the compressor for the companded domain (or simply the compressor), and to the compandor structure implementing the reverse mapping (expansion) function $c^{-1}$ (x) as the expander for the companded domain (or simply the expander).

The best ECSQ is one that minimizes D subject to the entropy constraint on the quantized values, $$R \approx h(X) - E[\log\left(\frac{\Delta}{c'(x)}\right) \leq R_c$$

and is given by:

$$c'(x)=\sqrt{w(x)}$$

$$\log(\Delta)=h(X)=R_c+E[\log(w(x))]/2 \quad (3)$$

where c' (x) is the slope of the compression function c(x). The operational distortion-rate function of the non-scalable ECSQ, $\delta_{ns}$, may be represented as, $$\delta_{ns}(R) = \frac{1}{12}2^{2(h(X)-R)-E(log(w(x)))} \quad (4)$$

For more details, see A. Gersho, "Asymptotically optimal block quantization," IEEE Trans. Inform. Theory, vol. IT-25, pp. 373–380, July 1979, and J. Li, N. Chaddha, and R. M. Gray, "Asymptotic performance of vector quantizers with a perceptual distortion measure," IEEE Trans. Inform. Theory, vol. 45, pp. 1082–90, May 1999.

Conventional Scalable (CS) Coding with ECSQ

Figure 1:
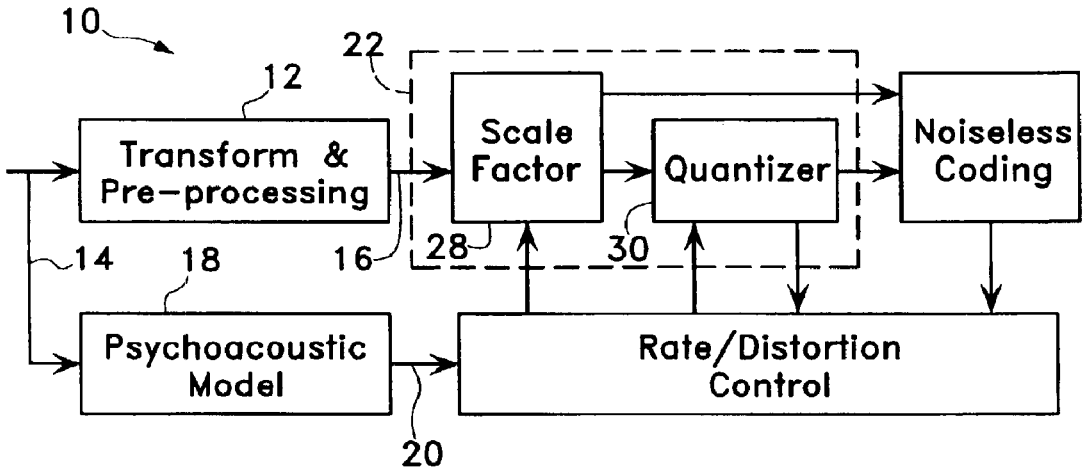
Fig. 1 (PRIOR ART)
FIG. 1 is a block diagram of a known base-layer AAC encoder.
Figure 2:
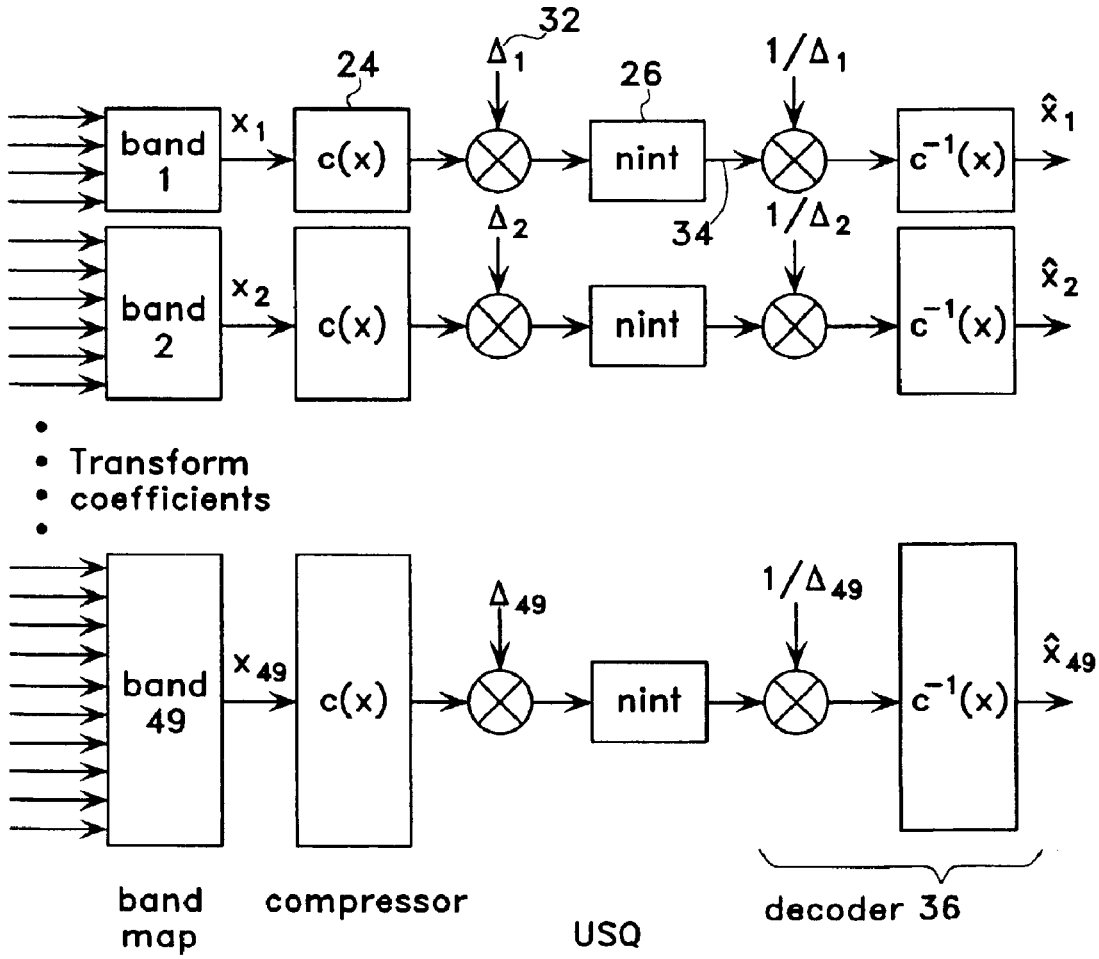
Fig. 2 (PRIOR ART)
FIG. 2 is a block diagram showing the scale factor and quantization blocks of FIG. 1 in further detail.
Figure 3:
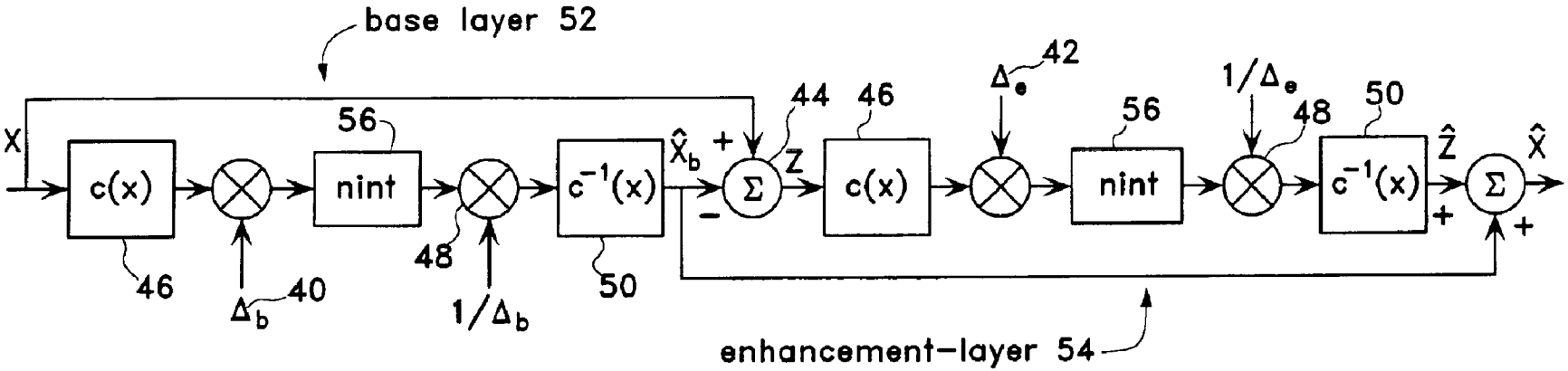
Fig. 3 (PRIOR ART)
FIG. 3 is a block diagram showing a conventional approach to quantization in one band of a two-layer scalable AAC.

Reference should now be made to the block diagram of a CS coder as shown in the previously mentioned FIG. 3. The compandor compression function 46 for both the base and the enhancement-layer is the same and is denoted by c(x). The uniform SQ stepsizes 40, 42 of the base and the enhancement-layer are denoted by $\Delta_b$ and $\Delta_e$, respectively. Let $\hat{x}$ be the overall reconstructed value of x, and z be the reconstruction error at the base-layer, then the distortion for the CS scheme is $$D_{cs} = \frac{\Delta_e^2}{12}\int_z \frac{K(z)}{c'(z)^2}\,dz \quad (5)$$

where $$K(z) = \int_{x:2c'(x)|z|\leq\Delta_b} w(x)c'(x)f_x(x)/\Delta_b\,dx.$$

The base and enhancement-layer rates are related to the quantizer stepsize by $$R_b=h(X)+E[\log(c'(x))]-\log(\Delta_b)$$

$$R_e=h(Z)+E[\log(c'(x))]-\log(\Delta_e) \quad (6)$$

The performance of CS in (5) is strictly worse than the bound (4), unless w(x)=1.

CSQ Coding with ECSQ

Figure 4:
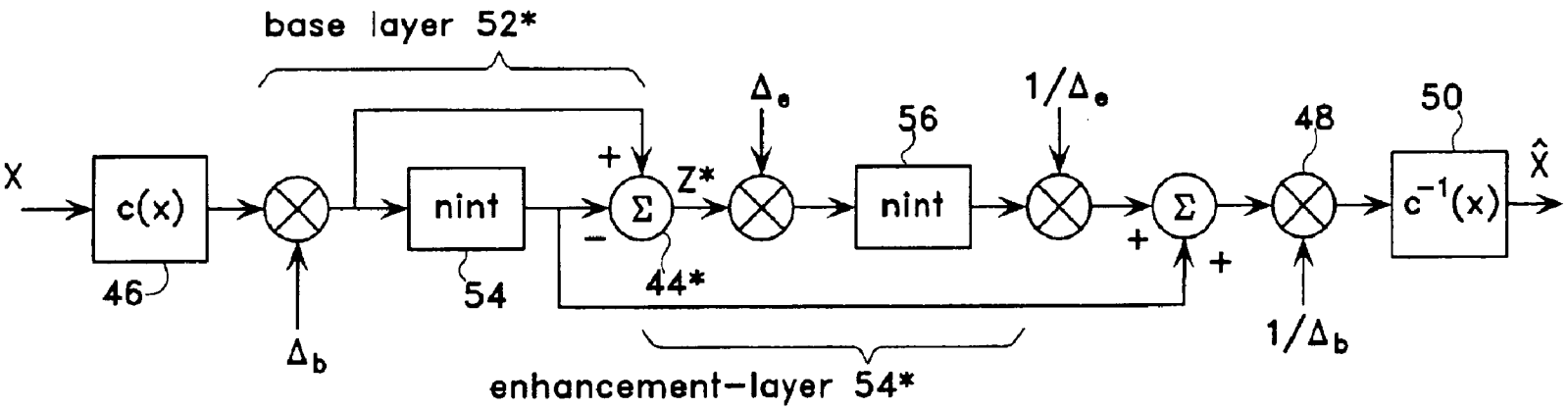
FIG. 4 is a block diagram of an improved scalable coder.

Reference should now be made to FIG. 4, which differs from CS ECSQ coder of FIG. 3 in at least one significant aspect: The input to the enhancement-layer error (z) is not reconstructed (expanded) error in the original domain, but is compressed error z* in the companded domain. This is indicated by the lack of any descaling function 48 and any expansion function 50 between the base-layer 52* and the enhancement-layer 54*. Rather, adder 44* merely subtracts the scaled but not yet quantized coefficient at the input to the nearest integer (nint) encoding function 56, to produce a companded domain error z* rather than a reconstructed error z. An AOS coder is one whose performance approaches the bound $\delta_{ns}$. We will now show the ECSQ coder shown in FIG. 4 achieves asymptotically optimal performance.

CS is optimal for the MSE criterion (w(x)=1).

The base and enhancement-layer rates in (6) reduce to, $$R_b|_{w(x)=1}=h(X)-\log(\Delta_b)$$

$$R_e|_{w(x)=1}=h(Z)-\log(\Delta_e)=\log(\Delta_b)-\log(\Delta_e).$$

For MSE, $K(z)=f_z(z)$, and distortion can be rewritten as $$\begin{aligned} D_{cs}|_{w(x)=1} &= \frac{1}{12}\Delta_e^2 \\ &= \frac{1}{12}2^{(h(X)-(R_b+R_e))} \\ &= \delta_{ns}(R_b+R_e)|_{w(x)=1}. \end{aligned}$$

For more details, see D. H. Lee and D. L. Neuhoff, "Asymptotic distribution of the errors in scalar and vector quantizers," IEEE Trans. Inform. Theory, vol. 42, pp. 4460, March 1996. (7)

For an optimally companded ECSQ, the WMSE of the original signal equals MSE of the companded signal.

For the optimal compressor function, (2) reduces to $D=\Delta^2/12$, which equals the MSE (in the companded domain) of the uniform SQ. These observations will now be applied to the exemplary block diagram of CSQ ECSQ shown in FIG. 4.

Let $D_{csq}$ be the distortion of the CSQ scheme, and $R_b$ and $R_e$ be the base and enhancement-layer rates. The rate-distortion performance of the coder is obtained as follows:

$$\begin{aligned} D_{csq} &= \frac{\Delta_e^2}{12} \quad (8) \\ R_b &= h(Y) - \log(\Delta_b) \\ &= h(X) + E[\log(c'(x))] - \log(\Delta_b) \\ R_e &= \log(\Delta_b) - \log(\Delta_e) \Rightarrow \\ D_{csq} &= \frac{1}{12}2^{2(h(X)-(R_b+R_e))+E[log(w(x))]} \\ &= \delta_{ns}(R_b+R_e) \end{aligned}$$

We thus achieve asymptotical optimality.

Companded Scalable Quantization Coding

The CSQ approach looks at the compander domain representation of a scalar quantizer, and achieves asymptotically-optimal scalability by requantizing the reconstruction error in the companded domain. The two main principles leading to the desired result are:

1. Quantizing the reconstruction error is optimal for the MSE criterion. For a uniform base-layer quantizer, under high resolution assumption, the pdf of the reconstruction error is uniform and hence, the best quantizer at the enhancement-layer is also uniform.
2. The optimal compressor for an entropy coded scalar quantizer maps the WMSE of the original signal to MSE in the companded domain. For such and optimal compressor function, Benneff's integral reduces to $D=\Delta^2/12$, which equals the MSE (in the companded domain) of a uniform quantizer with step size Δ. See for example W. R. Bennett, "Spectra of quantized signals," *Bell Syst. Tech. J.*, vol. 27, pp. 446–472, July 1948.

Thus, the compressor effectively reduces the minimization of the original distortion metric to an MSE optimization problem and requantizes the reconstruction error in the companded domain to achieve asymptotic optimality.

Asymptotically-Optimal Scalable AAC using CSQ

Figure 5:
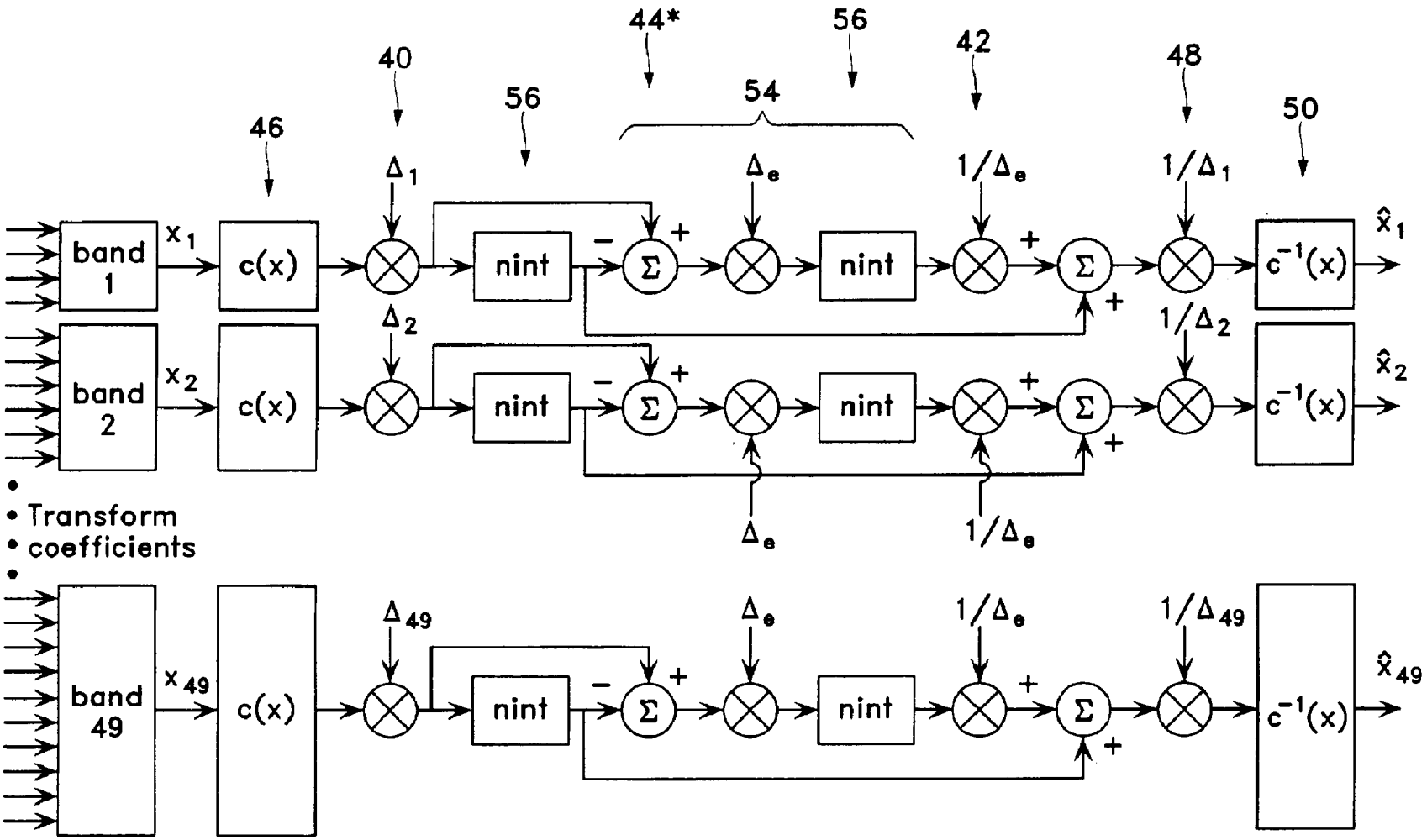
FIG. 5 is a block diagram of the coder of FIG. 4 modified for use with AAC.

We will now describe a particularly elegant way of extending the basic CSQ scheme of FIG. 4 to AAC. At the base-layer in AAC, once the coefficients are range compressed (c(x)) and scaled by the appropriate scale factor ($\Delta_b$), they are all quantized in the companded and scaled domain using the nearest-integer operation, i.e., the same SQ. We have found that these same base-layer quantizer scale factors may be used to rescale the corresponding bands of the enhancement-layer. Hence, for all the bands that were found to carry substantial information at the preceding layer, the enhancement-layer encoder can use a single scale factor for re-quantizing the reconstruction error in the companded and scaled domain of the current layer. In effect, the scale factors at the base-layer are being used to determine the enhancement-layer scale factors. Further, note that no expanding function $c^{-1}(x)$ is to the base-layer and that no additional compressing function c(x) is applied to the reconstruction error at the enhancement-layer. The block diagram of our CSQ-AAC scheme as shown in FIG. 5 is generally similarly to the CSQ ECSQ approach previously discussed with respect to FIG. 4. However, note that the same quantizer scale factor $\Delta_e$ 42 is used for all bands for all the coefficients at the enhancement-layer 54 that were found to carry substantial information at the base-layer, i.e., for which a scale factor was transmitted at the base-layer.

Simulation Results for CSQ AAC

In this section, we demonstrate that our CSQ coding scheme improves the performance of scalable AAC. Results are presented for a two layer scalable coder. We compare CSQ-AAC with conventional scalable AAC (CS-AAC) which was implemented as described previously. The CS-AAC is the approach used in scalable MPEG-4. The test database is 44.1 kHz sampled music files from the MPEG-4 SQAM database. The base-layer of both the schemes is identical. Table 1 shows the performance of a two-layer AAC for the competing schemes for two typical files at different combinations of base and enhancement-layer rates. The results show that CSQ-AAC achieves substantial gains over CS-AAC for two-layer scalable coding. The gains have been shown to accumulate with additional layers.

TABLE 1

| Rate (bits/second) | File 1 - WMSE (dB) | | File 2 - WMSE (dB) | |
|---|---|---|---|---|
| (base + enhancement) | CS-AAC | CSQ-AAC | CS-AAC | CSQ-AAC |
| 16000 + 16000 | 8.4562 | 7.5387 | 7.7320 | 6.6069 |
| 16000 + 32000 | 6.2513 | 5.3619 | 5.6515 | 5.1338 |
| 32000 + 32000 | 5.1579 | 1.9292 | 4.5799 | 1.8546 |
| 32000 + 48000 | 0.5179 | −1.2346 | 0.0212 | −2.7519 |
| 48000 + 48000 | −1.4053 | −3.4722 | −2.5259 | −5.1371 |

Conditional Enhancement-layer Quantization (CELQ)

The conditional density of the signal at the enhancement-layer can vary greatly with the base-layer quantization parameters, especially when the base-layer quantizer is not uniform, and the use of a single quantizer at the enhancement-layer is clearly suboptimal and a conditional enhancement-layer quantizer (CELQ) is indicated. However a separate quantizer for each base-layer reproduction is not only prohibitively complex, it requires additional side information to be transmitted thereby adversely impacting performance. For the important case that the source is well modeled by the Laplacian, we have found that the optimal CELQ may be approximated with only two distinct switchable quantizers depending on whether or not the base-layer reconstruction was zero. In particular, a multi-layer AAC with a standard-compatible base-layer may use such a dual quantizer CELQ in the enhancement-layers with essentially no additional computation cost, while still offering substantial savings in bit rate over the CSQ which itself considerably outperforms the standard technique.

The Non-Uniform AAC Quantizer

Figure 6:
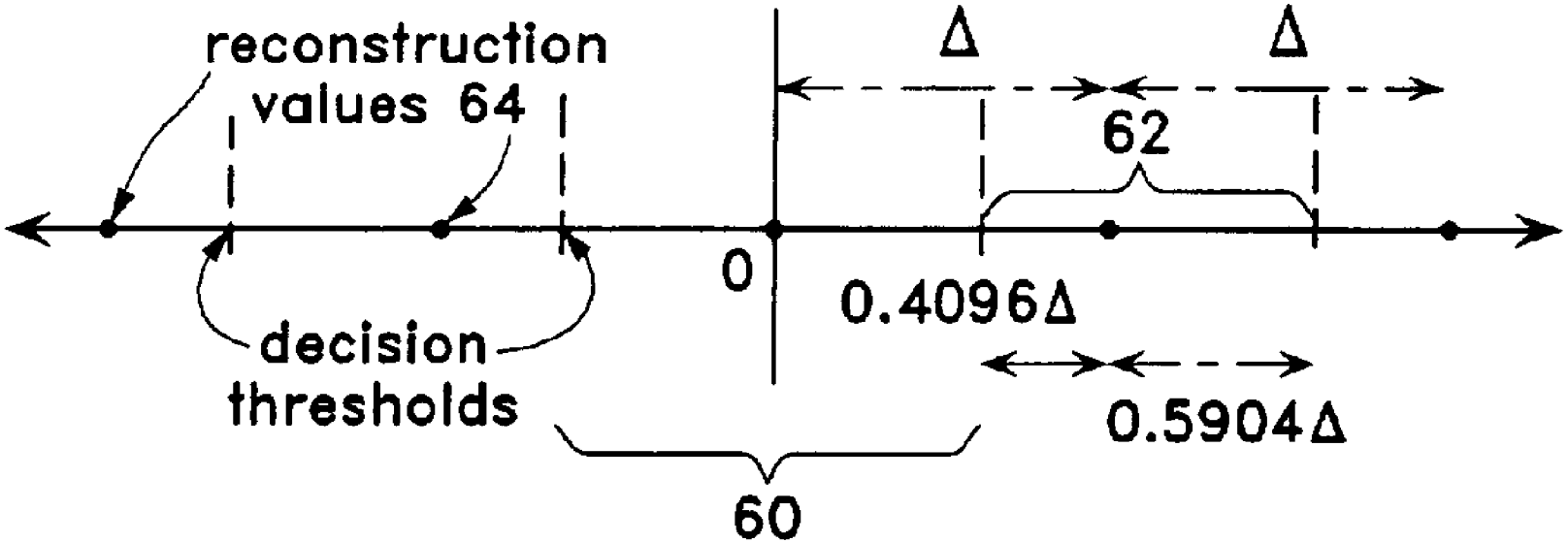
FIG. 6 shows the structure of the quantizer structure for the known AAC encoder of FIG. 1.

We consider a coder optimal when it minimizes the distortion metric for a given target bit rate. Under certain known assumptions as described in A. Gersho, "Vector Quantization and Signal Compression," Kluwer Academic, chapter 8, pp. 226–8, 1992, Fit follows from quantization theory that, the necessary condition for optimality is satisfied by ensuring that the WMSE distortion in each band is coefficient be constant. In AAC, this requirement is met using two stratagems. First, a non-uniform dead-zone quantizer is used to quantize the coefficients, thereby allowing a higher level of distortion when the value of a coefficient is high. Second, to account for different masking thresholds, or weights, associated with each band, the quantizer scale factor is allowed to vary from band to band. Effectively, quantization is performed using scaled versions of a fixed quantizer. The structure of this fixed quantizer for AAC is shown in FIG. 6. The quantizer has a "dead-zone" 60 around zero whose width ($2\times0.5904\Delta=1.1808\Delta$) is greater than the width ($1.0\Delta$) of the other intervals 62 and the reconstruction levels 64 are shifted towards zero. The width of the interval for all the indices except zero is the same. Using the terminology of G. J. Sullivan, "Efficient scalar quantization of exponential and Laplacian random variables," IEEE Trans. Inform. Theory, vol. 42, pp. 1365–74, Sep. 10, 1996, we call this quantizer a constant dead-zone ratio quantizer (CDZRQ).

In standard scalable AAC, the enhancement-layer quantization is constrained to use only the base-layer reconstruction error. Furthermore, AAC restricts the enhancement-layer quantizer to be CDZRQ, but 1) the weights of the distortion measure cannot be expressed as a function of the base-layer reconstruction error, and 2) the conditional density of the source given the base-layer reconstruction is different from that of the original source. Hence, the use of a compressor function and CDZRQ on the reconstruction error is not appropriate at the enhancement-layer. In order to optimize the distortion criterion the enhancement-layer encoder has to search for a new set of quantizer scale factors, and transmit their values as side information. At low rates of around 16 kbps, the information about quantizer scale factors of all the bands constitutes as much as 30%–40% of the bit stream. Moreover, the quantization loss due to ill suited CDZRQ at the enhancement-layer remains unabated. These factors are the main contributors to poor performance of conventional scalable AAC.

Conditional Enhancement-layer Quantizer Design

In deriving the CSQ result, a compressor function was used to map the distortion in the original signal domain to the MSE in the companded domain. The companded domain signal was then assumed to be quantized by a uniform quantizer. However, as demonstrated by G. J. Sullivan ["Efficient scalar quantization of exponential and Laplacian random variables," IEEE Trans. Inform. Theory, vol. 42, pp. 1365–74, September 1996] and T. Berger ["Minimum entropy quantizers and permutation codes," IEEE Trans. on IT, vol. 28, no. 2, pp. 149–57, March 1982], depending on the source pdf, the MSE-optimal entropy-constrained quantizer may not necessarily be uniform. Although a uniform quantizer can be shown to approach the MSE-optimal entropy-constrained quantizer at high rates, it may incur large performance degradation when coding rates are low.

Let us consider the design of the enhancement-layer quantizer when the base-layer employs a non-uniform quantizer in the companded domain. Optimality implies achieving the best rate-distortion trade-off at the enhancement-layer for the given base-layer quantizer. One method to achieve optimality, by brute force, is to design a separate entropy-constrained quantizer for each base-layer reproduction. This approach is prohibitively complex. However, for the important case of the source distribution being Laplacian, optimality can be achieved by designing different enhancement-layer quantizers for just two cases: when the base-layer reproduction is zero and when it is not. The argument follows from the memoryless property of exponential pdf's which can be stated as follows: given that an exponential distributed variable X lies in an interval [a, b], where 0<a<b, the conditional pdf of X—a depends only on the width of the interval a–b. Since Laplacian is a two sided exponential, the memoryless property extends for the Laplacian pdf when the interval [a, b] does not include zero.

Recollect that CDZRQ (FIG. 6) has constant quantization width everywhere except around zero. It can be shown that the conditional distribution at the enhancement-layer given the base-layer index, for a Laplacian pdf quantized using CDZRQ, is independent of the base-layer reconstruction when the base-layer index is not zero. Hence, when the base-layer reconstruction is not zero, only one quantizer is sufficient to optimally quantize the reconstruction error at the enhancement-layer. Thus, only two switch-able quantizers are required to optimally quantize the reconstruction error when the input source is Laplacian. They are switched depending on whether or not the base-layer reconstruction is zero.

Figure 7:
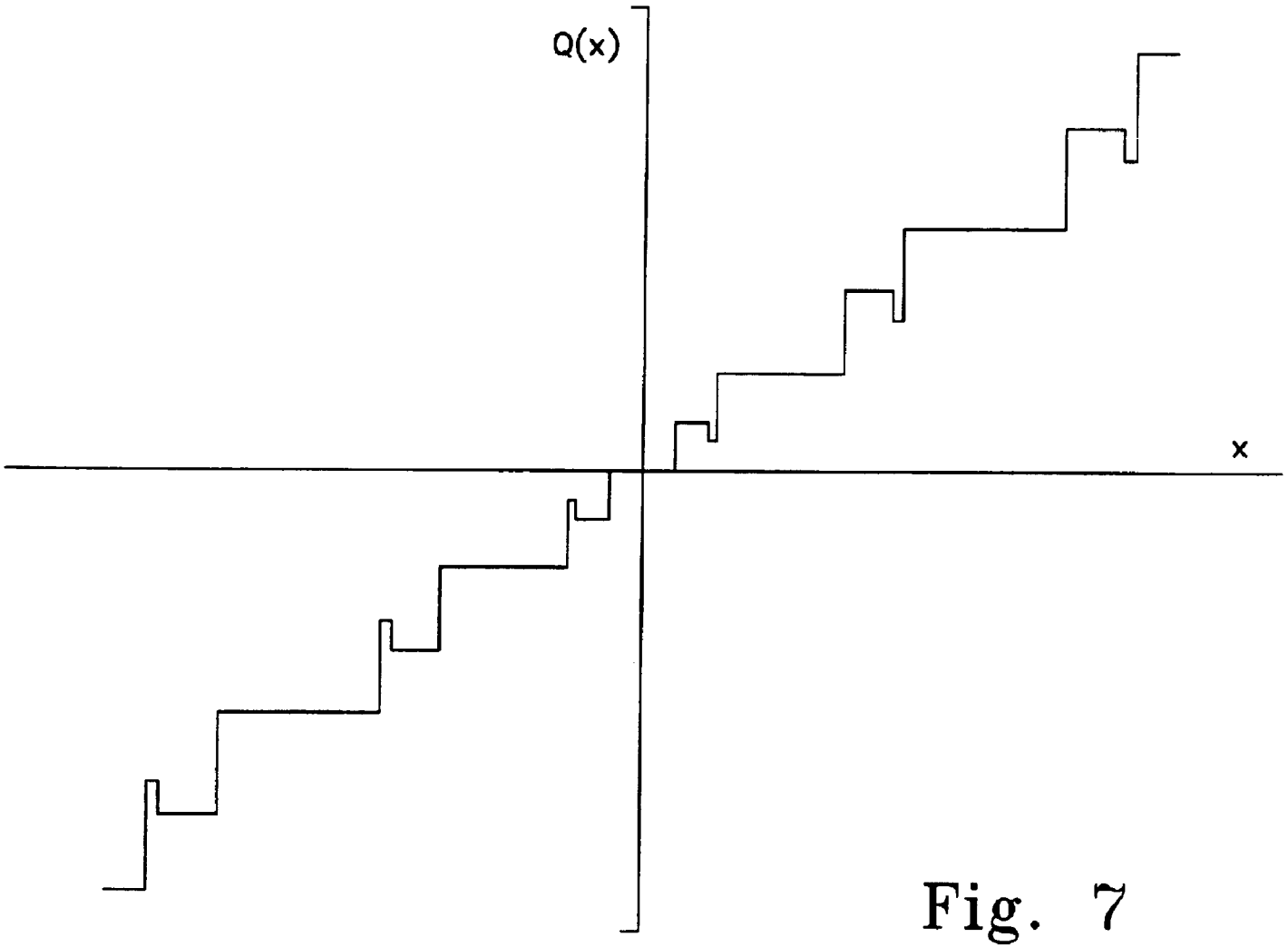
FIG. 7 shows boundary discontinuities associated with the known AAC encoder of FIG. 6.

Approximation to the two optimal quantizers can be made without significant loss in performance by employing CDZRQ and a uniform threshold quantizer (UTQ). When the base-layer reconstruction is zero, the enhancement-layer continues to employ a scaled version of CDZRQ. Otherwise, it employs a UTQ. The reproduction value within the interval is the centroid of the pdf over the interval (see G. J. Sullivan ["Efficient scalar quantization of exponential and Laplacian random variables," IEEE Trans. Inform. Theory, vol. 42, pp. 1365–74, September 1996] and T. Berger ["Minimum entropy quantizers and permutation codes," IEEE Trans. on IT, vol. 28, no. 2, pp. 149–57, March 1982]). Further, the reconstructed value at the enhancement-layer is adjusted to always lie within the base-layer quantization interval. This adjustment is made because, though the interval in which the coefficient lies is known from the base-layer, as shown in FIG. 7, it may so happen that its reproduction at the boundary of the enhancement-layer quantizer may fall outside the interval. Hence, the reproduction values at the boundary of the enhancement-layer quantizer are preferably adjusted such that they lie within the base-layer quantization interval.

Since the transform coefficients of a typical audio signal are reasonably modeled by the Laplacian pdf, and AAC uses CDZRQ at the base-layer, such a simplified CELQ may thus be implemented within the scalable AAC in a relatively straight-forward manner. When the base-layer reconstruction is not zero, the enhancement-layer quantizer is switched to use a UTQ. The reconstruction value of the quantizer is shifted towards zero by an amount similar to AAC. When the base-layer reconstruction is zero, the enhancement-layer continues to use a scaled version of the conventional base-layer CDZRQ.

Scalable AAC using CSQ and CELQ

Figure 8:
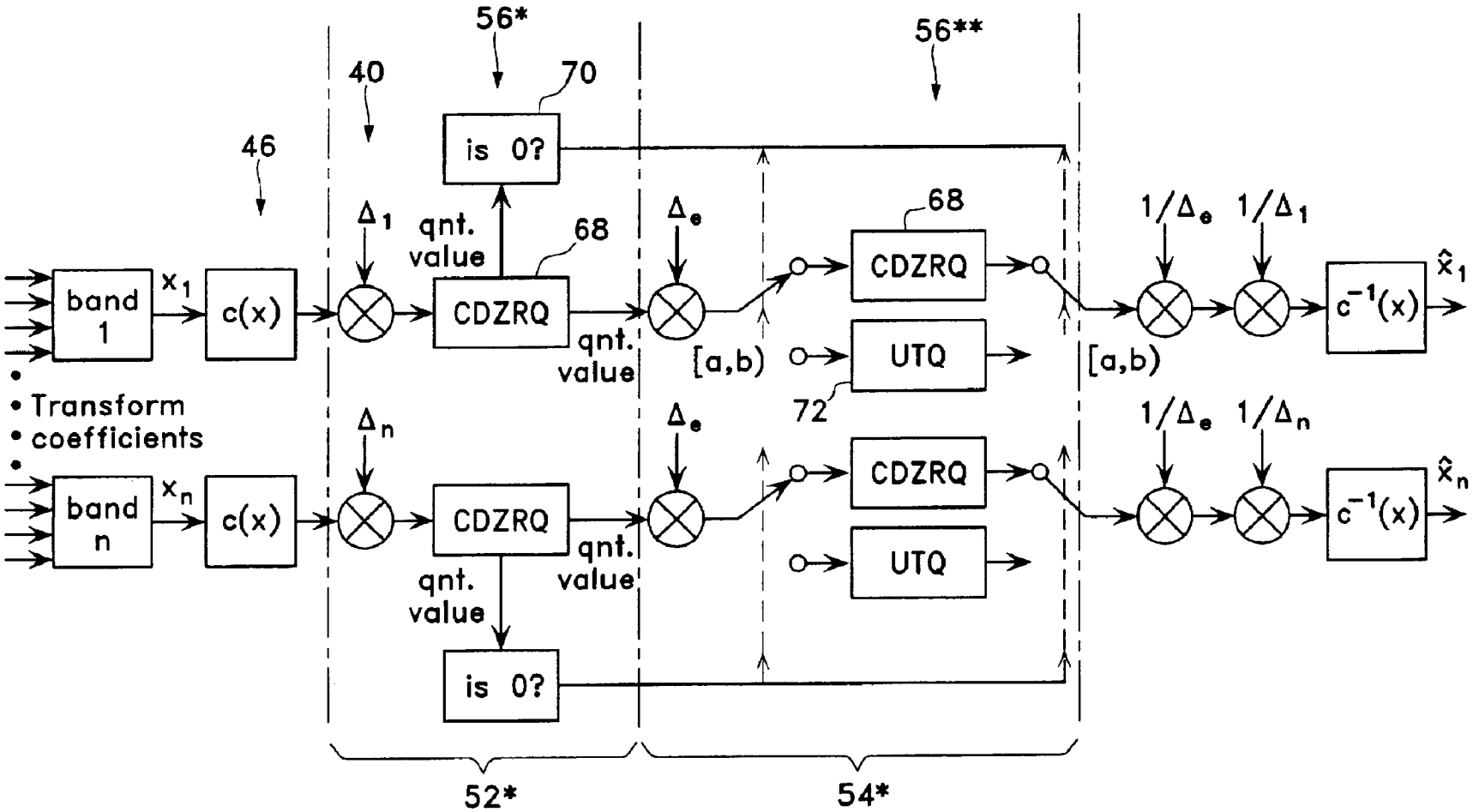
FIG. 8 is a block diagram of a novel conditional coder for use with AAC.

As shown in FIG. 8, our CSQ and CELQ schemes can be implemented within AAC in a straight-forward manner. At the AAC base-layer 52*, once the coefficients are companded (block 46) and scaled (block 40) by the appropriate stepsize $\Delta_i$, they are all quantized (block 56*) using the same CDZRQ quantizer 68.

If the base-layer quantized value is zero (block 70) the enhancement-layer quantizer 56 simply uses a scaled version of the base-layer CDZRQ quantizer 68**.

Otherwise, assuming that the quantizer stepsizes $\Delta_i$ at the base-layer are chosen correctly, optimizing MSE in the "companded and scaled domain" is equivalent to optimizing the WMSE measure in the original domain, and a single uniform threshold quantizer (UTQ) 72 is used for requantizing all the reconstruction error in the companded and scaled domain.

In effect, the scale factors at the base-layer are being used as surrogates for the enhancement-layer scale factors and only one resealing parameter ($\Delta_e$) is transmitted for the quantizer scale factors of all the coefficients at the enhancement-layer which were found to be significant at the base-layer. A simple uniform-threshold quantizer is used at the enhancement-layer when the base-layer reconstruction is not zero. The reproduction value within the interval is the centroid of the pdf over the interval and the reconstructed value at the enhancement-layer is adjusted to always lie within the base-layer quantization interval.

Comparative Performance of CELQ-AAC

We compared CELQ-AAC with conventional scalable AAC (CS-AAC) and also with CSQ-AAC which was implemented as described previously. The CS-AAC is the approach used in scalable MPEG-4. The test database is 44.1 kHz sampled music files from the MPEG-4 SQAM database. The base-layer of both the schemes is identical. Table 2 shows the calculated performance of a two-layer AAC for the competing schemes for two typical files at different combinations of base and enhancement-layer rates. The results show that CELQ-AAC achieves substantial gains over CS-AAC for two-layer scalable coding.

TABLE 2

| Rate (bits/second) | Average - WMSE (dB) | |
|---|---|---|
| (base + enhancement) | CELQ-AAC | CS-AAC |
| 16000 + 16000 | 2.8705 | 6.0039 |
| 16000 + 32000 | 0.1172 | 2.9004 |
| 16000 + 48000 | −2.0129 | −0.5020 |
| 32000 + 32000 | −1.9374 | 1.7749 |
| 32000 + 48000 | −4.3301 | −1.3661 |
| 48000 + 48000 | −6.2110 | −2.8129 |

We also compared CSQ with and without the conditional enhancement-layer quantizer (CELQ) to the conventional scalable MPEG-AAC. The test database is 44.1 kHz sampled music files from the MPEG-4 SQAM database. The base-layer for all the schemes is identical and standard-compatible.

Objective Results for a Multi-layer Coder

Figure 9:
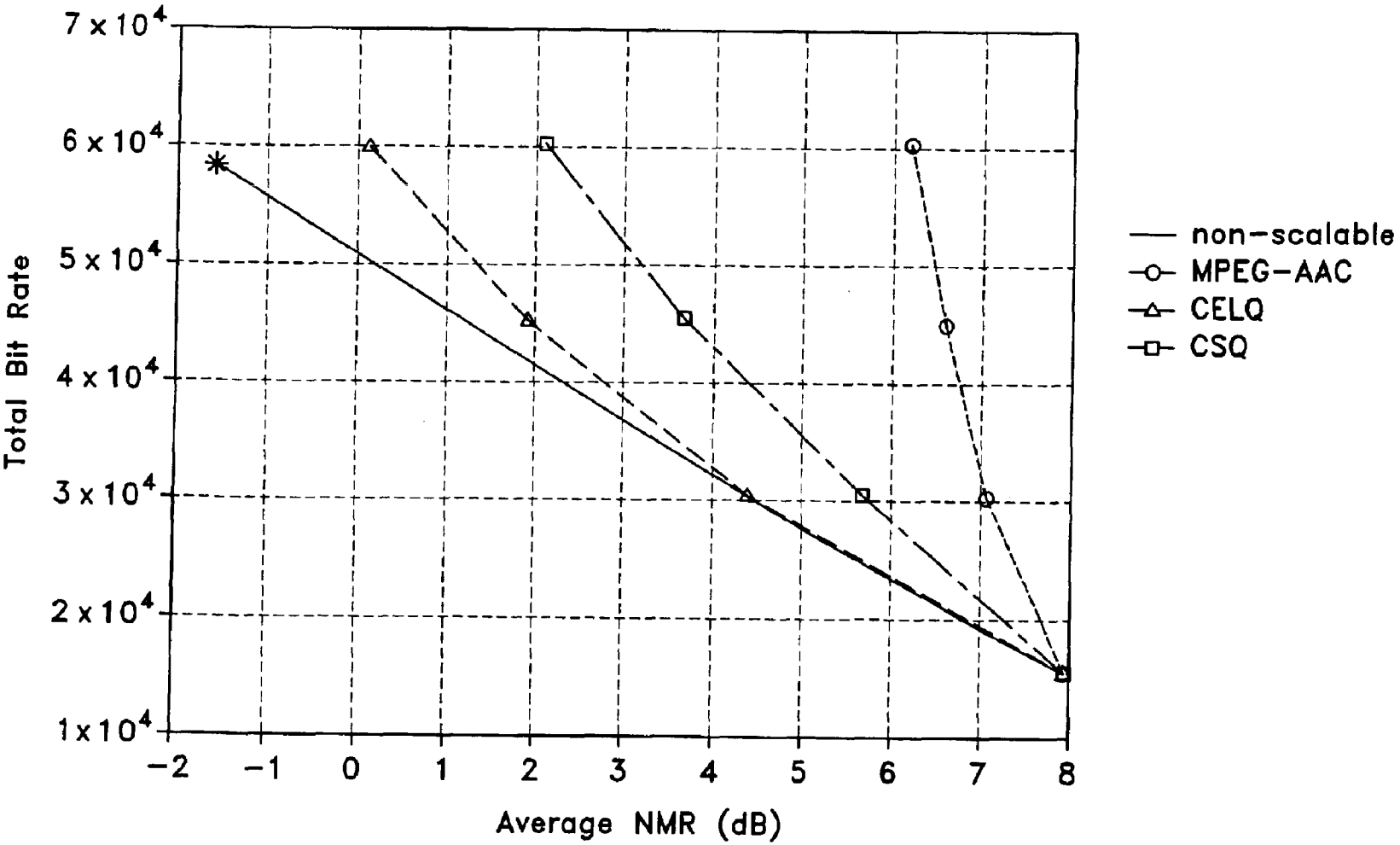
FIG. 9 depicts the rate-distortion curve of a four-layer implementation of the coder of FIG. 8 with each layer operating at 16 kbps.

FIG. 9 depicts the rate-distortion curve of four-layer coder with each layer operating at 16 kbps. The point • is obtained by using the coder at 64 kbps non-scalable mode. The solid curve is the convex-hull of the operating points and represents the operational rate-distortion bound or the non-scalable performance of the coder.

Subjective Results for a Multi-layer Coder

We performed an informal subjective "AB" comparison test for the CELQ consisting of four layers of 16 kbps each and the non-scalable coder operating at 64 kbps. The test set contained eight music and speech files from the SQAM database, including castanets and German male speech. Eight listeners, some with trained ears, performed the evaluation. Table 3 gives the test results showing the subjective performance of a four-layer CELQ (16×4 kbps), and non-scalable (64 kbps) coder.

TABLE 3

| Preferred nscal @ 64 kbps | Preferred CELQ @ 16 × 4 kbps | No Preference |
|---|---|---|
| 26.56% | 26.56% | 46.88% |

From FIG. 9 and Table 2 it can be seen that our CELQ scalable coder with a very low rate layer achieves performance very close to the non-scalable coder, with bit rate savings of approximately 20 kbps over CSQ and 45 kbps over MPEG-AAC.

Other implementations and enhancements to the disclosed exemplary embodiments will doubtless be apparent to those skilled in the art, both today and in the future. In particular, the invention may be used with multiple signals and/or multiple signal sources, and may use predictive and correlation techniques to further reduce the quantity of information being stored and/or transmitted.

What is claimed is:

1. A bit-rate scalable coder for generating a reduced bit rate representation of a digital signal with an associated distortion metric, the coder comprising:

a first quantizer mechanism operating in at least a base-layer for producing scaled and quantized base-layer coefficients from said coefficients;

a base-layer error mechanism for producing base-layer error signals from the unquantized scaled coefficients and the scaled and quantized coefficients; and a second quantizer mechanism operating selectively in one or more enhancement-layers quantizer mechanism for producing quantized enhancement-layer signals from said base-layer error signals;

wherein selection of the second quantizer mechanism is dependent on an outcome of the first quantizer mechanism.

2. The bit-rate scalable coder of claim 1 wherein the enhancement-layer comprises two distinct quantizer mechanisms and a selected said enhancement-layer quantizer mechanism is applied in a particular enhancement-layer to a particular error signal coefficient depending on the outcome of the quantizer mechanism that produced that coefficient in a preceding layer.

3. The bit-rate scalable coder of claim 1 wherein when the first quantizer mechanism produces a value of zero for a particular coefficient in a particular layer, a scaled version of that first quantizer mechanism is used in a subsequent enhancement-layer to quantize error signals for that coefficient.

4. The bit-rate scalable coder of claim 1 wherein when said first quantizer mechanism produces a non-zero quantized signal for a particular coefficient, a uniform quantizer mechanism is used in all the subsequent enhancement-layers to quantize the error signals for that coefficient.

5. The bit-rate scalable coder of claim 1 wherein in at least one enhancement-layer, the quantizer scaling factor associated with said second quantizer mechanism is derived from a quantization interval associated with the first quantizer mechanism.

6. The bit-rate scalable coder of claim 1 wherein the coder is an AAC coder and the reversible compression mechanism implements the function $|x|^{0.75}$ [absolute value to the power 3 over 4].

7. A bit-rate scalable AAC coder for generating a reduced bit rate representation of a digital audio signal having spectral coefficients organized into bands with an associated perceptually weighted distortion metric, the coder comprising:

a reversible compression mechanism for performing a non-linear reversible compression function $|x|^{0.75}$ [absolute value to the power 3 over 4] on input signal coefficients from said bands;

a first quantizer mechanism operating in at least a base-layer for producing scaled and quantized base-layer coefficients from said coefficients;

a base-layer error mechanism for producing base-layer error signals from the unquantized scaled coefficients and the scaled and quantized coefficients; and a second quantizer mechanism operating selectively in one or more enhancement-layers quantizer mechanism for producing quantized enhancement-layer signals from said base-layer error signals;

wherein selection of the second quantizer mechanism is dependent on an outcome of the first quantizer mechanism;

the enhancement-layer comprises two distinct quantizer mechanisms and a selected said enhancement-layer quantizer mechanism is applied in a particular enhancement-layer to a particular error signal coefficient depending on the outcome of the quantizer mechanism that produced that coefficient in a preceding layer;

when the first quantizer mechanism produces a value of zero for a particular coefficient in a particular layer, a scaled version of that first quantizer mechanism is used in a subsequent enhancement-layer to quantize error signals for that coefficient;

when said first quantizer mechanism produces a non-zero quantized signal for a particular coefficient, a uniform quantizer mechanism is used in all the subsequent enhancement-layers to quantize the error signals for that coefficient; and in at least one enhancement-layer, the quantizer scaling factor associated with said second quantizer mechanism is derived from a quantization interval associated with the first quantizer mechanism.

8. A bit-rate scalable coder for generating a reduced bit rate representation of a digital signal with an associated weighted distortion metric, the coder comprising:

a compression mechanism for performing a non-linear reversible compression function on input signal coefficients to thereby produce compressed coefficients in an associated companded domain;

a base-layer quantizer mechanism operating in the companded domain and responsive to scaling factors from a distortion metric control circuit for producing quantized companded base-layer signals from said compressed coefficients;

a base-layer error mechanism also operating in the companded domain for producing a companded and scaled base-layer error signal from the unquantized scaled coefficients and the quantized coefficients; and an enhancement-layer quantizer mechanism operating in the same companded domain as the base-layer quantizer mechanism for producing quantized companded enhancement-layer signals from said companded and scaled base-layer error signals.

9. The bit-rate scalable coder of claim 8 wherein a non-weighted distortion metric is optimized for the said compressed coefficients in said associated companded domain.

10. The bit-rate scalable coder of claim 8 wherein each said quantizer mechanism comprises a uniform quantizer with dead zone rounding and said scaling factors represent scaling of an associated said quantizer.

11. The bit-rate scalable coder of claim 8 wherein in at least one enhancement-layer, a scaling factor associated with said enhancement-layer quantizer mechanism is derived from a quantization interval associated with said base-layer quantizer mechanism.

12. The bit-rate scalable coder of claim 8 wherein the coder is an AAC coder and the reversible compression mechanism implements the function $|x|^{0.75}$ [absolute value to the power 3 over 4].

13. The bit-rate scalable coder of claim 8 wherein in at least one enhancement-layer, all said scaling factors are the same.

14. The bit-rate scalable coder of claim 8 wherein in at least the base-layer, not all the quantizer scaling factors are the same.

15. The bit-rate scalable coder of claim 8 wherein each of said quantizer mechanisms comprises a nearest integer mechanism.

16. The bit-rate scalable coder of claim 8 wherein each of said quantizer mechanisms is a uniform interval mechanism.

17. A bit-rate scalable AAC coder for generating a reduced bit rate representation of a digital signal having spectral coefficients organized into bands with an associated perceptually weighted distortion metric, the coder comprising:

a compression mechanism for performing the non-linear reversible compression function $|x|^{0.75}$ [absolute value to the power 3 over 4] on input signal coefficients to thereby produce compressed coefficients in an associated companded domain;

a base-layer quantizer mechanism operating in the companded domain and responsive to scaling factors from a distortion metric control circuit for producing quantized companded base-layer signals from said compressed coefficients;

a base-layer error mechanism also operating in the companded domain for producing a companded and scaled base-layer error signal from the unquantized scaled coefficients and the quantized coefficients; and an enhancement-layer quantizer mechanism operating in the same companded domain as the base-layer quantizer mechanism for producing quantized companded enhancement-layer signals from said companded and scaled base-layer error signals;

wherein a non-weighted distortion metric is optimized for the said compressed coefficients in said associated companded domain;

each said quantizer mechanism comprises a uniform quantizer with dead zone rounding;

said scaling factors represent scaling of an associated said quantizer;

in at least one enhancement-layer, a scaling factor associated with said enhancement-layer quantizer mechanism is derived from a quantization interval associated with said base-layer quantizer mechanism; and each of said quantizer mechanisms is a uniform interval mechanism.

18. The bit-rate scalable coder of claim 17 wherein in at least one enhancement-layer, all said scaling factors are the same.

19. The bit-rate scalable coder of claim 17 wherein in at least the base-layer, not all the quantizer scaling factors are the same.

20. The bit-rate scalable coder of claim 17 wherein each of said quantizer mechanisms comprises a nearest integer mechanism.

21. The bit-rate scalable coder of claim 17 wherein each said quantizer mechanism comprises a uniform quantizer with dead zone rounding and each said scaling factors represents scaling of the quantizer mechanism in a respective coefficient band.

22. The bit-rate scalable coder of claim 17 wherein the coder is an AAC coder and the reversible compression mechanism implements the function $|x|^{0.75}$ [absolute value to the power 3 over 4].

23. The bit-rate scalable coder of claim 17 wherein in at least one enhancement-layer, said quantizer scaling in at least some of said coefficients are directly derived from the quantizer scaling of the corresponding coefficients at the base-layer.

24. The bit-rate scalable coder of claim 17 wherein in at least the base-layer, not all the scaling factors are the same.

25. The bit-rate scalable coder of claim 17 wherein the quantizer mechanism comprises a nearest integer mechanism.

26. A bit-rate scalable coder for generating a reduced bit rate representation of a digital signal with an associated weighted distortion metric, the coder comprising:

a base-layer quantizer mechanism responsive to scaling factors from a distortion metric control circuit for producing unquantized scaled coefficients and quantized base-layer coefficients in a scaled domain;

a base-layer error mechanism also operating in the scaled domain for producing base-layer error signals from the unquantized scaled coefficients and the quantized coefficients; and an enhancement-layer quantizer mechanism operating in the same scaled domain as the base-layer quantizer mechanism for producing quantized enhancement-layer signals from said base-layer error signals.

27. A bit-rate scalable AAC coder for generating a reduced bit rate representation of a digital signal having spectral coefficients organized into bands with an associated perceptually weighted distortion metric, the coder comprising:

a compression mechanism for performing a non-linear reversible compression function $|x|^{0.75}$ [absolute value to the power 3 over 4] on input signal coefficients from said bands;

a base-layer quantizer mechanism responsive to scaling factors from a distortion metric control circuit for producing unquantized scaled coefficients and quantized base-layer coefficients in a scaled domain;

a base-layer error mechanism also operating in the scaled domain for producing base-layer error signals from the unquantized scaled coefficients and the quantized coefficients; and an enhancement-layer quantizer mechanism operating in the same scaled domain as the base-layer quantizer mechanism for producing quantized enhancement-layer signals from said base-layer error signals.

wherein each said quantizer mechanism comprises a uniform quantizer with dead zone rounding and each said scaling factors represents scaling of the quantizer mechanism in a respective coefficient band;

in at least one enhancement-layer, the quantizer scaling factors for at least some of said coefficients are directly derived from respective quantizer scaling factors of corresponding coefficients at the base-layer;

in at least the base-layer, not all the scaling factors are the same;

at least some of the quantizer mechanisms comprises a uniform interval mechanism; and in at least one enhancement-layer, the quantizer scaling factors are the same for at least some of said bands.

* * * * *